US007357186B1

(12) United States Patent
Berry

(10) Patent No.: US 7,357,186 B1
(45) Date of Patent: Apr. 15, 2008

(54) RECIRCULATION GAS SEPARATOR

(75) Inventor: Michael R. Berry, Norman, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 278 days.

(21) Appl. No.: 11/106,933

(22) Filed: Apr. 15, 2005

(51) Int. Cl.
*E21B 43/00* (2006.01)

(52) U.S. Cl. ..... 166/369; 166/68

(58) Field of Classification Search ..... 166/265, 166/105.5, 105.6
See application file for complete search history.

(56) References Cited

U.S. PATENT DOCUMENTS

| | | | | |
|---|---|---|---|---|
| 2,285,169 | A | 6/1942 | Pyle | |
| 2,311,963 | A | 2/1943 | Pyle | |
| 2,525,233 | A | 10/1950 | Miller | |
| 2,652,130 | A * | 9/1953 | Ferguson | 166/54 |
| 2,748,719 | A * | 6/1956 | Wells | 166/105.5 |
| 3,624,822 | A * | 11/1971 | Carle et al. | 417/313 |
| 3,887,342 | A * | 6/1975 | Bunnelle | 96/214 |
| 4,088,459 | A | 5/1978 | Tuzson | |
| 4,231,767 | A | 11/1980 | Acker | |
| 4,330,306 | A | 5/1982 | Salant | |
| 4,481,020 | A * | 11/1984 | Lee et al. | 96/214 |
| 4,531,584 | A | 7/1985 | Ward | |
| 4,676,308 | A | 6/1987 | Chow et al. | |
| 4,832,709 | A | 5/1989 | Nagyszalanczy | |
| 4,840,645 | A | 6/1989 | Woodworth et al. | |
| 4,901,413 | A * | 2/1990 | Cotherman et al. | 29/890.14 |
| 4,913,630 | A * | 4/1990 | Cotherman et al. | 417/313 |
| 4,981,175 | A * | 1/1991 | Powers | 166/265 |
| 5,207,810 | A | 5/1993 | Sheth | |
| 5,209,765 | A | 5/1993 | Kolpak et al. | |
| 5,333,684 | A | 8/1994 | Walter et al. | |
| 5,482,117 | A * | 1/1996 | Kolpak et al. | 166/265 |
| 5,525,146 | A * | 6/1996 | Straub | 96/214 |
| 5,845,709 | A * | 12/1998 | Mack et al. | 166/302 |
| 6,066,193 | A * | 5/2000 | Lee | 95/261 |
| 6,155,345 | A * | 12/2000 | Lee et al. | 166/105.5 |
| 6,257,333 | B1 | 7/2001 | Mann et al. | |
| 6,761,215 | B2 | 7/2004 | Morrison et al. | |
| 2003/0111230 | A1* | 6/2003 | Olson et al. | 166/369 |
| 2003/0145989 | A1* | 8/2003 | Shaw et al. | 166/265 |

* cited by examiner

*Primary Examiner*—Frank Tsay
(74) *Attorney, Agent, or Firm*—Crowe & Dunlevy, P.C.

(57) ABSTRACT

A submersible pumping system includes a pump, a motor that drives the pump and a separator assembly. The separator assembly is for separating gas from the fluid and includes an intake and a vent above the intake. Fluid enters the separator assembly at the intake and the vent returns a portion of the fluid into wellbore for recirculation into the intake.

15 Claims, 3 Drawing Sheets

RECIRCULATION GAS SEPARATOR

FIELD OF THE INVENTION

This invention relates generally to the field of downhole pumping systems, and more particularly to gas separators for separating gas from well fluid prior to pumping.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the petroleum fluids from a production stream in the subterranean reservoir to a storage facility on the surface.

Production streams usually contain a combination of liquids and gases, and excessive amounts of gases in the production stream can cause the pump to malfunction or operate inefficiently. In progressive cavity pumps, gas pockets occupy space in the pump that could otherwise be occupied by desirable liquids, thereby lowering the efficiency of the pump. Most pumps work best with a gas concentration in the production stream of less than twenty five percent.

Rotary gas separators have been used to remove gas from production streams before entry into the pump. Rotary gas separators take advantage of the difference in specific gravities of gas and liquids by using centrifugal force to separate the gas and liquid components. Rotary mechanisms such as spinning chambers force the liquids to the outside radius of the rotary separator and the gases remain near the inside radius of the rotary separator because liquids are heavier than gases.

The radial positions of the liquids and gases after centrifugal separation are disadvantageously located for the desired venting of the gases to the wellbore and the axial pumping of the liquids. To solve this problem, rotary separators often employ crossover mechanisms that transfer the liquids to the center of the separator for entry into the pump and transfer the gases to the outer radius of the separator for venting away from the pump. These mechanisms include passages that route the gases and liquids to the desired location for venting into the wellbore or for pumping to the surface. The rotary and crossover mechanisms add complexity and cost to the separators, and can result in costly downtime for the submersible pumping system when repairs are needed.

It would therefore be desirable to separate liquids and gases in a production stream without the use of complex mechanisms that increase manufacturing and maintenance costs. It is to these and other deficiencies in the prior art that the present invention is directed.

SUMMARY OF THE INVENTION

In a preferred embodiment, the present invention provides a submersible pumping system for producing a fluid from a wellbore. The submersible pumping system includes a pump, a motor that drives the pump and a separator assembly. The separator assembly is for separating gas from the fluid and includes an intake and a vent above the intake. Fluid enters the separator assembly at the intake and the vent returns a portion of the fluid into the wellbore for recirculation into the intake.

In alternate preferred embodiments, the separator assembly includes a shaft rotated by the motor, an inducer rotated by the shaft, and an orifice positioned between the vent and the pump.

The present invention provides a method for separating gas from a wellbore fluid. The method includes moving the wellbore fluid from an intake through a separator assembly, diverting a portion of the wellbore fluid from the separator assembly into the wellbore, and recirculating the diverted wellbore fluid into the intake.

DETAILED DESCRIPTION OF THE PREFERRED EMBODIMENT

Figure 1:
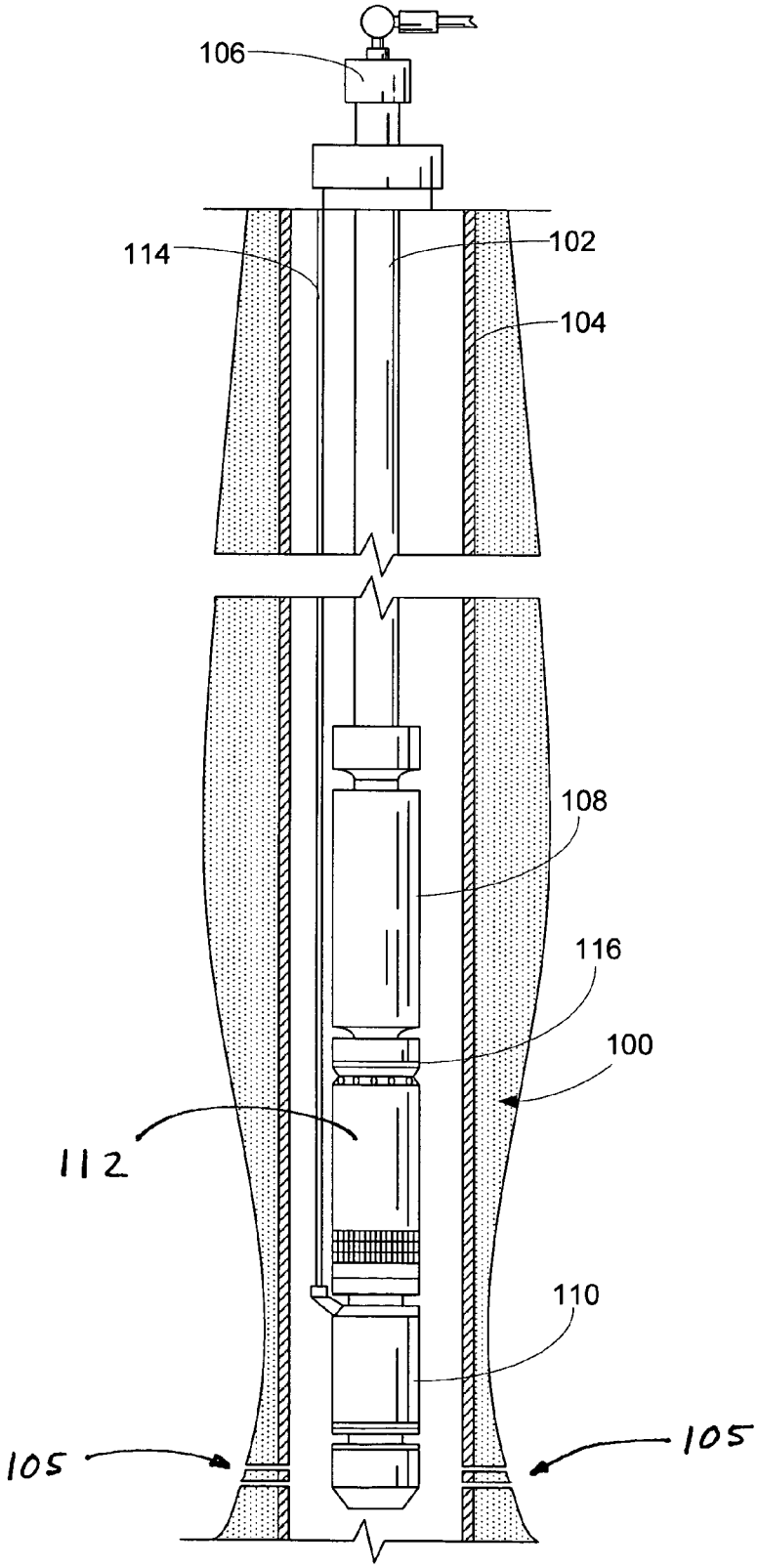
FIG. 1 is an elevational view of an electric submersible pumping system disposed in a wellbore constructed in accordance with a preferred embodiment of the present invention.

In accordance with a preferred embodiment of the present invention, FIG. 1 shows an elevational view of a pumping system 100 attached to production tubing 102. The pumping system 100 and production tubing 102 are disposed in a wellbore 104, which is drilled for the production of a fluid such as water or petroleum. As used herein, the term "petroleum" refers broadly to all mineral hydrocarbons, such as crude oil, gas and combinations of oil and gas. Petroleum enters the wellbore 104 through perforations 105. The production tubing 102 connects the pumping system 100 to a wellhead 106 located on the surface. Although the pumping system 100 is primarily designed to pump petroleum products, it will be understood that the present invention can also be used to move substances that consist of other fluids.

The pumping system 100 preferably includes some combination of a pump assembly 108, a motor assembly 110 and a separator assembly 112. Although not shown, the pumping system 100 can also include components such as seal sections, gear boxes and various sensors. The motor assembly 110 is provided with power from the surface by a power cable 114. The motor assembly 110 preferably drives the pump assembly 108 to move a fluid from the wellbore 104 to the surface through the production tubing 102.

Figure 2:
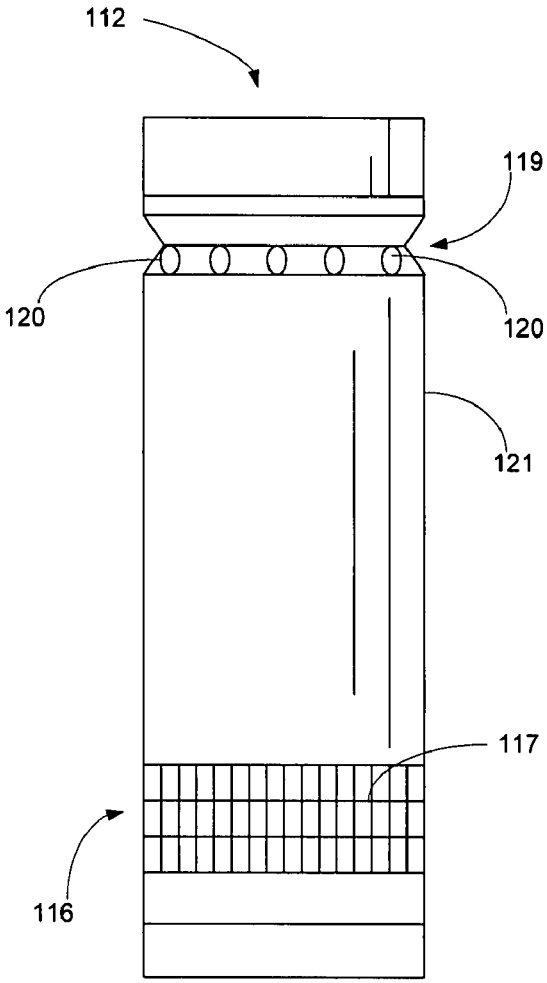
FIG. 2 is an elevational view of a separator assembly for use with the electrical submersible pumping system FIG. 1.
Figure 3:
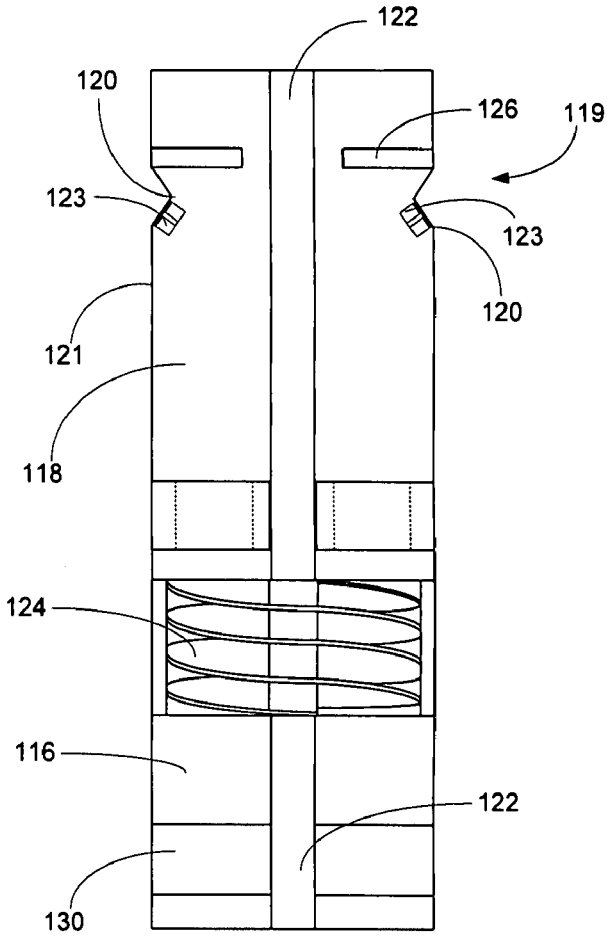
FIG. 3 is a cross section view of the separator assembly of FIG. 2.

Turning to FIGS. 2 and 3, shown therein are elevational and cross-sectional views of the separator assembly 112, respectively. The separator assembly 112 preferably includes an intake 116, a chamber 118, a neck 119, and vents 120. The intake 116 permits well fluid to enter the separator 112 and is preferably fitted with a screen 117 that blocks large pieces of rock, dirt or other debris that may be present in the wellbore.

The chamber 118 acts as a conduit for the flow of fluid through the separator assembly 112, and is generally defined to be cylindrically shaped by a housing 121. The neck 119 is preferably situated towards the top of the separator assembly 112, and in a presently preferred embodiment, is characterized by a narrowing of the housing 121 and includes vents 120 that link the chamber 118 to the wellbore 104. The vents 120 may optionally include one-way valves 123 that restrict fluid flow by only allowing fluid to exit the chamber 118. It will be understood that the size and angular disposition of the vents 120 can be varied to control the amount of fluid in the chamber 118 that exits the separator assembly 112, as discussed in more detail below.

The separator assembly 112 can also include a shaft 122, an inducer 124, an orifice plate 126, and support bearings 128, 130. The inducer 124, which is preferably affixed to the rotating shaft 122 by a keyed connection or other known methodology, imparts energy to the fluid as the inducer 124 spins with the rotating shaft 122. The inducer 124 preferably increases the pressure in the chamber 118 to a level greater than the pressure in the wellbore 104. The positive head pressure created by the inducer 124 prevents well fluid from flowing into the chamber 118 through vents 120. For applications in which the separator assembly 112 is located between the pump 108 and the motor 110, the shaft 122 also transfers rotational energy from the motor 110 to the pump 108.

Figure 4:
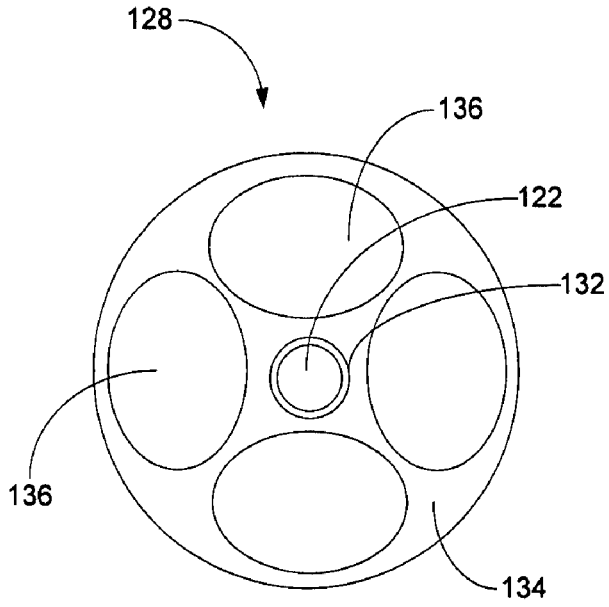
FIG. 4 is a top plan view of a support bearing for use with the separator assembly of FIG. 2.

Turning to FIG. 4, shown therein is a top plan view of support bearing 128. The support bearing 128 includes a sleeve 132 and a collar 134. The sleeve 132 is fixed to the shaft 122 and the collar 134 is fixed to the housing 121. The sleeve 132 rotates with the shaft 122 while the collar 134 remains stationary. The support bearing 128 is located in the chamber 118 where the fluid flows from the intake 116 to the top of the separator assembly 112. To permit the flow of fluid through the chamber 118, the support bearing 128 includes fluid passages 136. In this way, the support bearing 128 provides axial alignment to the shaft 122 without hindering the flow of fluid through the chamber 118.

Figure 5:
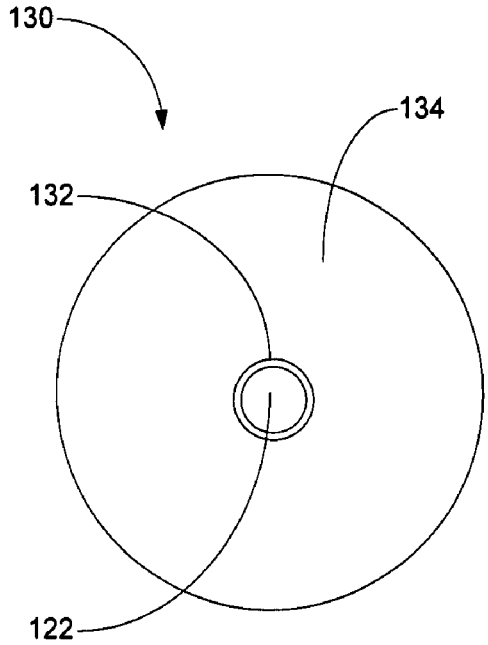
FIG. 5 is a top plan view of a support bearing for use with the separator assembly of FIG. 2

Turning now to FIG. 5, shown therein is a top plan view of support bearing 130. The support bearing 130 preferably includes a sleeve 132 fixed to the shaft 122 and a collar 134 fixed to the housing 121. Because the support bearing 130 is positioned below the intake 116, fluid passages are not necessary. Support bearings such as support bearing 130 do not require fluid passages if they are located in areas where the flow of fluid is not needed or desired.

Figure 6:
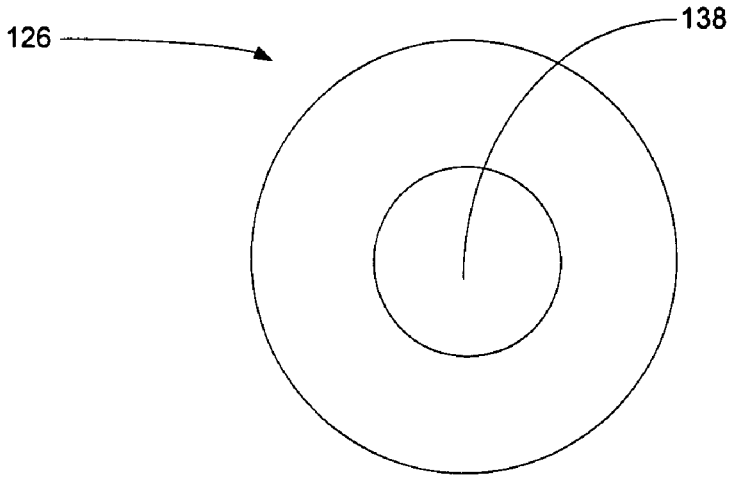
FIG. 6 is a top view of an orifice plate for use with the separator of FIG. 2.

Turning to FIG. 6, shown therein is a top plan view of the orifice plate 126. The orifice plate 126 is fixed to the housing 121 of the separator assembly 112 and provides an orifice 138 through which well fluid flows out of the chamber 118 toward the pump 108. The size of the orifice 138 affects the volumetric flow of fluid from the separator assembly 112 into the pump assembly 108 and recirculation. Various sizes of orifice 138 can be chosen to regulate fluid flow based on factors such as pump capacity and the desired flow of fluid in the separator assembly 112. It will be understood that the movement of well fluid through the separator assembly 112 is caused by the cooperative operation of the motor 110 and the pump assembly 108.

During operation, well fluid enters the separator assembly 112 at intake 116. As the well fluid in the chamber 118 reaches the vents 120, well fluid from an outer diameter of the chamber 118 is diverted into the wellbore 104 through the vents 120 and the remaining portion of the well fluid in the chamber 118 flows toward the pump 108.

As well fluid exits the vents 120 into the wellbore 104, gas in the vented fluid ascends toward the top of the wellbore and the remaining well fluid (with a higher concentration of liquid) descends toward the intake 116 for recirculation through the separator assembly 112. As the recirculation continues, well fluid entering the separator assembly 112 becomes less encumbered with gas. The gas level of the well fluid in the separator assembly 112 thereby decreases with continuous recirculation of the vented well fluid.

Because untreated well fluid is constantly introduced into the intake 116 from the perforations 105 in the well, the maximum reduction of gas content is limited by the amount of gas in the untreated well fluid. It is thought that the percentage by which the gas content of the well fluid is reduced is approximately equal to the percentage of well fluid vented into the wellbore from the chamber 118 after the system has reached a steady state. For example, well fluid from a formation that produces a gas concentration of twenty percent is expected to be reduced to a gas concentration of about ten percent if half the well fluid is vented back into the wellbore. Likewise, seventy five percent venting should result in a fluid stream of five percent gas content that reaches the pump.

In the presently preferred embodiment, the vents 120 direct about fifty percent of the well fluid moving through the separator assembly 112 from the chamber 118 to the wellbore 104. This amount can be varied by changing the size and angular disposition of the vents 120, and by adjusting the size of the orifice 138. If a greater reduction of gas is desired, more fluid should be vented and recirculated. Variations in recirculation rates can be chosen based on characteristics such as the performance of the pump and the gas content of the well. For example, some types of pumps that are sensitive to a high gas content will require more well fluid to be recirculated. Similarly, wells with a high gas content may also require more well fluid to be recirculated.

The reduction of gas content is also affected by the amount of time the separator assembly 112 is in operation. The commencement of recirculation of fluid in the separator assembly 112 begins the process of reducing gas content from the level found in untreated well fluid. Only after sufficient time has elapsed will the separator assembly 112 reduce the gas content to the theoretical limit.

The efficiency of the recirculation process depends at least in part on the amount of time in which gas is allowed to separate from liquid as it recycles outside the separator assembly 112. The "separation time" can be controlled by adjusting the velocity of the recycle stream and/or the length of the recycle path. The velocity of the recycle stream can be controlled by varying the outer diameter of the separator assembly 112 with respect to the inner diameter of the wellbore 104. The length of the recycle path can be controlled by modifying the length of the separator assembly 112, and more particularly the distance between the vents 120 and the intake 116.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A submersible pumping system for producing a fluid from a wellbore, comprising:

a pump;

a motor that drives the pump; and a separator assembly for separating gas from liquid in the fluid, the separator assembly comprising:

an intake where fluid enters the separator assembly; and a vent above the intake that returns a portion of the gas and liquid in the fluid into the wellbore for recirculation into the intake.

2. The submersible pumping system of claim 1, wherein the separator assembly further comprises:

a shaft rotated by the motor; and an inducer rotated by the shaft.

3. The submersible pumping system of claim 1, further comprising an orifice positioned between the vent and the pump.

4. The submersible pumping system of claim 1, further comprising a neck, wherein the vent is disposed in the neck.

5. The submersible pumping system of claim 1, wherein the vent includes a one-way valve.

6. A separator assembly for use with a pump and a motor in a wellbore, the separator assembly comprising:

an intake where fluid enters from the wellbore; and a vent above the intake that returns a portion of the gas and liquid in the fluid into the wellbore for recirculation into the intake.

7. The separator assembly of claim 6, further comprising:

a shaft rotated by the motor; and an inducer rotated by the shaft.

8. The separator assembly of claim 6, further comprising an orifice positioned between the vent and the pump.

9. The separator assembly of claim 6, further comprising a neck that includes the vent.

10. The separator assembly of claim 6, wherein the vent is a one-way valve.

11. A method for separating gas from a wellbore fluid that includes both liquid and gaseous components, the method comprising:

moving the wellbore fluid through a separator assembly;

diverting a portion of the wellbore fluid from the separator assembly into the wellbore, where gaseous components separate from liquid components in response to gravity; and recirculating the diverted wellbore fluid into the separator assembly.

12. The method of claim 11, further comprising a step of increasing the pressure of the wellbore fluid in the separator assembly.

13. The method of claim 11, further comprising a step of pumping the portion of the wellbore fluid that is not diverted from the separator assembly through production tubing to a wellhead.

14. The method of claim 11, further comprising a step of regulating a flow of the wellbore fluid that is not diverted.

15. The method of claim 11, further comprising a step of restricting the flow of fluid into the separator assembly.

* * * * *